United States Patent [19]

Brown, Jr.

[11] Patent Number: 4,594,485

[45] Date of Patent: Jun. 10, 1986

[54] IMPACT SENSOR

[76] Inventor: Milton F. Brown, Jr., 1105 Hartwood Ave., Virginia Beach, Va. 23454

[21] Appl. No.: 719,877

[22] Filed: Apr. 4, 1985

[51] Int. Cl.[4] ..... H01H 35/14

[52] U.S. Cl. ..... 200/61.45 R; 200/61.53

[58] Field of Search ..... 200/61.45 R, 61.45 M, 200/61.46, 61.47, 61.48, 61.49, 61.50, 61.51, 61.25, 61.53; 340/669; 280/735

[56] References Cited

U.S. PATENT DOCUMENTS

| | | | |
|---|---|---|---|
| 2,671,832 | 3/1954 | Hansard et al. | 200/61.53 |
| 3,177,312 | 4/1965 | Clarke | 200/61.45 R |
| 3,688,063 | 8/1972 | Bell | 200/61.53 |

*Primary Examiner*—A. D. Pellinen
*Assistant Examiner*—Morris Ginsburg
*Attorney, Agent, or Firm*—Shlesinger, Arkwright, Garvey & Fado

[57] ABSTRACT

An impact sensor has a housing with an inner chamber. A first electrical contact extends from the housing and has a contact portion disposed in the chamber. A second electrical contact extends from the housing and is spaced from the first contact and has an aperture in the housing surrounding the contact portion. An insulating material is disposed between the contacts for maintaining electrical isolation of the contacts. A plastically deformed conductive arcuate spring is in electrical connection with the second contact along generally the periphery of the aperture and has a first position arched away from the contact portion and a second position arched toward and engaged with the contact portion for thereby establishing electrical connection between the contacts. A mass is movably positioned in the chamber and is engageable with the spring for shifting the spring from the first to the second position upon detection of a collision.

22 Claims, 7 Drawing Figures

FIG 1
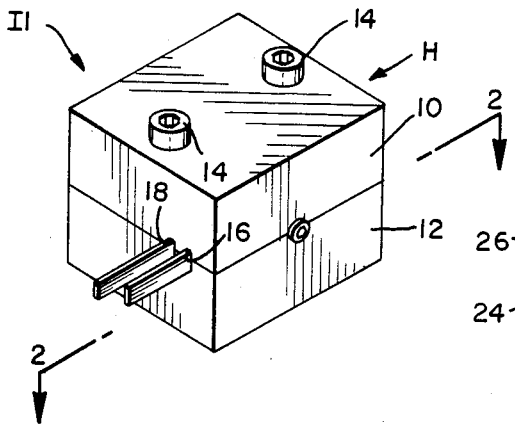
FIG 2
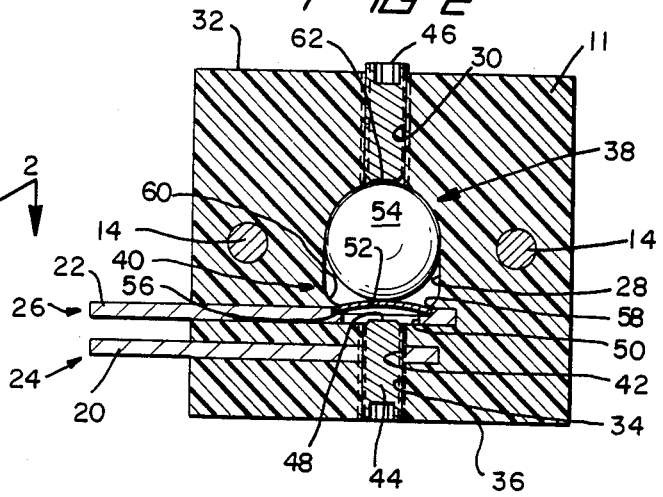
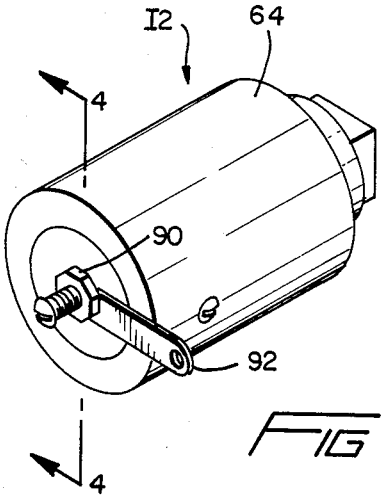
FIG 3
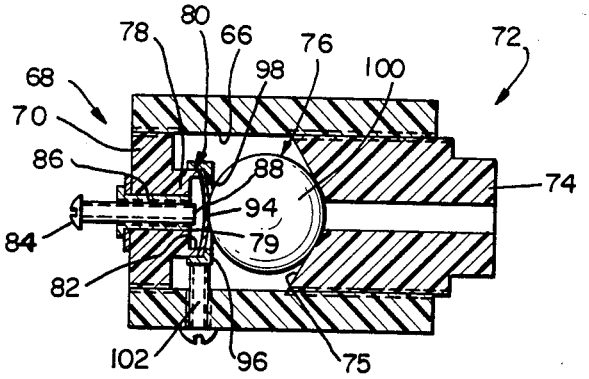
FIG 4
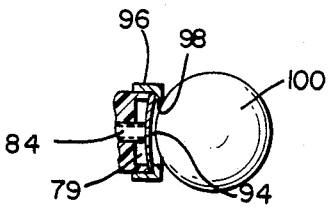
FIG 5
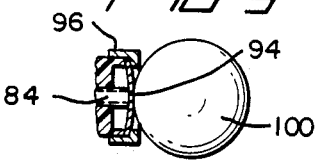
FIG 6
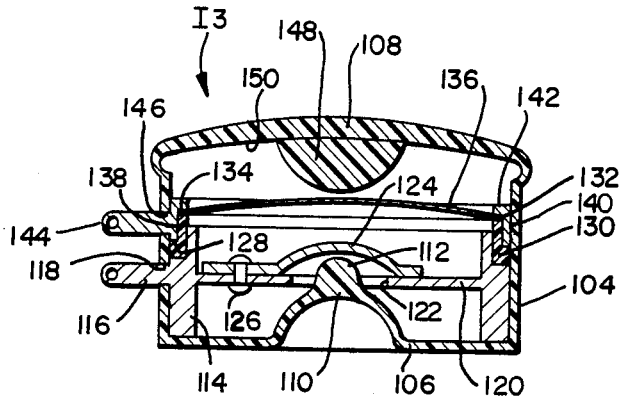
FIG 7

IMPACT SENSOR

BACKGROUND OF THE INVENTION

An air bag is a passive device which is appropriately positioned in a vehicle, such as an automobile or a truck, and which is utilized to lessen the possibility of injury to the occupants in the event of a collision. Typically, a pressurized gas canister has a frangible valve mechanism which is ruptured in response to a signal transmitted to a thermitic device by a sensor so that gas may issue from the canister in order to inflate the bag.

Typically, the sensor is mounted to the frame of the vehicle approximately two feet or so rearward of the front end. As a result therefore, the front end of the vehicle must deform before the sensor is activated. Generally, approximately 10 milliseconds are required for the front end to deform to a significant extent during a collision. Subsequent to this, the thermitic device must rupture the valve and the bag must inflate. Collision sensing and bag inflation must be accomplished in no more than 30 milliseconds for the bag to adequately protect the user. The entire collision is usually completed in approximately 150 milliseconds.

Collision sensing is accomplished by reaction of the sensor to a sudden deceleration of the vehicle. The sensor must therefore be capable of distinguishing between rapid braking and a collision or else the bag may unnecessarily inflate, and possibly cause unintended damage. It is therefore readily apparent that vehicle collision sensors must be capable of acting with extreme speed and yet be able to distinguish between a collision and other forms of rapid deceleration.

Clarke, U.S. Pat. No. 3,177,312, discloses a slug type inertia switch. Clarke, particularly FIG. 2, discloses the utilization of a flat spring which closes the electric circuit between associated wires upon the slug being subjected to a minimum decelerating force. Clarke discloses that the spring may be a disc or a strip but fails to appreciate that an arcuate plastically deformed spring has significantly faster spring action. The switch speed of Clarke is limited to the marginal speed of the slug. The switch of Clarke is advantageously utilized with an artillery shell rather than a vehicle, and for this reason, switch speed is relatively unimportant. The relatively low reaction speed of Clarke is not appropriate for use in a vehicle. Furthermore, the spring of Clarke would have a tendency to resist movement of the slug and would not maintain positive contact without application of force.

From the above, it can be seen that a collision impact sensor which has rapid response and which distinguishes between a collision and other forms of rapid deceleration is necessary. The disclosed invention provides such a switch by mounting an arcuate conductive plastically deformed spring to a contact. The spring is concave in its first or open position and shifts or flips to a convex position wherein another contact is engaged upon the spring being subjected to force application by a movable mass. Preferably, the contact holding the spring has an aperture therethrough permitting the spring to snap through the plane of the contact for establishing electrical connection with the other contact. In this way, the conductive spring is an integral part of the circuit because current flows through the spring connecting the contacts. Means are also provided for resetting the switch and for biasing the spring so as to cause flexing whereby the speed of response is increased.

OBJECTS AND SUMMARY OF THE INVENTION

The primary object of the disclosed invention is to provide an impact sensor which has rapid response time and yet which is capable of distinguishing between a collision and intended rapid deceleration.

A further object of the disclosed invention is to provide a conductive plastically deformed arched or hemispherical spring to connect the contacts and thereby complete the circuit.

A further object of the disclosed invention is to provide a biasing means for positioning the mass so that the spring is flexed whereby the response time is greatly increased.

Yet another object of the disclosed invention is to provide a reset mechanism operable for shifting the spring from its closed position to the open position.

In summary, the disclosed invention is an impact sensor which is capable of rapid response to a predetermined deceleration by means of the plastically deformed hemispherical spring which shifts between a concave or open position and a convex or closed position in response to a mass. Preferably, a biasing mechanism bears against the mass, causing the spring to flex so as to be partially shifted toward the second or closed position. The biasing mechanism is adjustable in order to permit regulation of the response time.

A reset mechanism is engagable with the spring when in the convex position and shifts the spring from the second or closed position to the first or open position. The reset device is, preferably, coaxial with the spring disc and is aligned with the mass.

Utilization of a plastically deformed spring is preferred because the linear movement of the mass required to depress the spring to more than ½ the depth of the spring arc is almost negligible. Once this depth has been achieved, then the spring flips in the opposite direction at a speed many times that of the mass in order to close the circuit.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a perspective view of a first embodiment of the impact sensor of the invention;

FIG. 2 is a cross-sectional view taken along the section 2—2 of FIG. 1 and viewed in the direction of the arrows;

FIG. 3 is a perspective view of a second embodiment of the invention;

FIG. 4 is a cross-sectional view of the embodiment of FIG. 3 taken along the section 4—4 of FIG. 3 and viewed in the direction of the arrows;

FIG. 5 is a fragmentary cross-sectional view of the sensor of FIG. 3 disclosing the spring in the second or closed position;

FIG. 6 is a fragmentary cross-sectional view of the sensor of FIG. 3 disclosing the reset mechanism; and, FIG. 7 is a cross-sectional view of yet another embodiment of the invention.

DESCRIPTION OF THE INVENTION

Impact sensor I1, as best shown in FIGS. 1 and 2, includes a housing H comprising cooperating housing sections 10 and 12 having contiguous faces, the face 11 of which is shown in FIG. 2. Sections 10 and 12 are secured together by bolts 14, or other securing means well known. Bolts 14 also secure impact sensor I1 to the frame of a motor vehicle, for example an automobile. The sections 10 and 12 are comprised of an insulating material, such as nylon or the like. Each of the sections 10 and 12 have cooperating aligned recesses 16 and 18 in the contiguous faces thereof which seat and position contacts 20 and 22, respectively with respect to the housing H. The contacts 20 and 22 are flat and are maintained in spaced parallel relation because of recesses 16 and 18 and the insulating material comprising sections 10 and 12, as best shown in FIG. 2. In this way, unintended electrical communication between the contacts 20 and 22 is prevented. The outer ends 24 and 26 of the contacts 20 and 22, respectively, are adapted for connection to respective poles of a power source (not shown) for supplying electricity through impact sensor I1 to a thermitic device (not shown) or other device component.

As best shown in FIG. 2, each of the housing sections 10 and 12 has a cooperating recess 28 therein, although only the recess 28 of section 12 is shown in FIG. 2. The cooperating and aligned recesses 28 thereby provide a chamber in the housing H provided by the joined sections 10 and 12. A threaded aperture 30 extends from face 32 of housing H into the associated recess 28 and is partially disposed in the contiguous faces of sections 10 and 12. Another threaded aperture 34 is coaxially aligned with aperture 30 and extends inwardly from face 36 to the cooperating recesses 28 and is likewise partially disposed in each of the contiguous faces of sections 10 and 12. In this way, the apertures 30 and 34, in cooperation with the recesses 28, provide a chamber in sensor I1 which extends outwardly from recesses 28 by means of apertures 30 and 34. It can be noted that recess 28 in section 12 has an upper, as viewed in FIG. 2, hemispherical portion 38 and a lower squat or square-off portion 40.

Contact 20 has a threaded aperture 42 therein aligned with aperture 34 and in which stud 44 is threadedly received so as to be movable into and out of the aperture 34 and the associated recess 28. A similar stud 46 is threadedly received in threaded aperture 30 and is likewise adapted for inward and outward motion, for reasons to be explained hereinafter.

Stud 44 has a contact portion 48, as best shown in FIG. 2, which is positioned within aperture 50 of contact 22. Aperture 50 is coaxial with aperture 42 but has a diameter substantially exceeding the diameter of aperture 42 in order to permit plastically deformed conductive spring 52 to be free to engage contact portion 48 in response to application thereto of force by means of movement of mass 54. Those skilled in the art will realize that the mass 54 should be facing toward the collision so as to be able to properly react with spring 52. Preferably, contact 22 has an annular recess 56 which receives the peripheral edge 58 of spring disc 52. Squat portion 40 has an inwardly-turned lip 60 which bears on peripheral edge 58 and thereby maintains the spring 52 seated in recess 56.

The spring disc 52 is, preferably, comprised of a conductive material, such as an electrical grade of stainless steel, in order to permit current to flow between contacts 22 and 20 when disc 52 is engaged with contact portion 48. A plastically deformed spring disc is preferred because plastic deformation gives a permanent set to the metal and thereby creates tension rings. A plastically deformed spring is preferred because negligible movement of the mass 54 is required to depress the spring 52 to more than ½ the depth of the arc of the spring. Once this mid-point has been achieved, then the spring 52 flips in the opposite direction at a speed many times the speed at which the mass 54 is moving. Consequently, a plastically deformed spring will flip at a speed much exceeding the speed of movement of the mass.

Depression pressure on one side of a plastically deformed spring, such as spring 52, produces tension lines in the material comprising the spring. These tension lines make it more difficult, by a factor of 2–3 times, to shift or flip the deformed spring toward the side in which the force was originally applied. Consequently, the plastically deformed spring 52 provides a strong contact giving positive closure when flipped, and closure which is maintained when the deceleration stops or changes.

While the spring 52 is disclosed as being a hemispherically-shaped disc 52, those skilled in the art will appreciate that the spring 52 may include a plastically deformed flat spring, or other similar configuration. It is merely required that the spring 52 be plastically deformed so that it will flip from the first concave or open position of FIG. 2 to a second convex position wherein the spring 52 engages the contact portion 48. In this way, rapid deceleration of the vehicle is sensed by the mass 54 which, as a consequence, begins to move toward the stud 44. The mass 54 bears upon or is proximate the spring 52 so that movement of the mass 54 causes a depression force to be applied to the disc 52. Once the disc 52 has been depressed by more than ½ the depth of the spring arc, then the spring 52 will flip to the second or contact closed position at a speed much exceeding the speed at which the mass 54 moves. Because of the plastic deformation of the spring 52, the spring will remain in the closed or convex position and will not spring back to the open position. This thereby assures good positive contact once the spring has been sufficiently depressed by the mass 54.

The movable stud 44 is used to reset the spring 52. Movement of the stud 44 into the chamber provided by recesses 28 causes the spring 52 to flip from its second or convex position to the first or concave position of FIG. 2. Because of the speed with which the spring flips, an audible sound is produced which permits the person resetting the sensor I1 to know that the device is ready for use again. The stud 44 is then backed off until it is in the proper position for engagement with the spring 52. Naturally, the stud 44 should be backed-off to no more than a point wherein it is engageable with the spring 52.

The stud 46 is utilized to reduce the reaction time of sensor I1, by biasing the spring 52. Movement of the stud 46 into the chamber provided by the recesses 28 causes the end portion 62 to bear against the mass 54. The mass 54 is thereby positioned in the chamber provided by the recesses 28 at a point causing the spring 52 to be slightly depressed or flexed, so that less depression movement is required to cause the spring 52 to flip.

Consequently, the response speed of the impact sensor I1 may be regulated by approximate adjustment of the stud 46.

As best shown in FIGS. 3 and 4, impact sensor I2 consists of a hollow cylindrical housing 64 comprised of an insulating material. The housing 64 has a central longitudinal aperture 66. End 68 of housing 64 is closed by plug 70, comprised of an insulating material, while end 72 is closed by plug 74, likewise comprised of an insulating material. Plugs 70 and 74 are coaxial and are longitudinally spaced apart in order to provide a chamber 76 in housing 64. Plug 70 has a central longitudinal extension 78 having a terminal or forward end 80. Recess 82 is disposed in extension 78 and is coaxial with screw contact 84 so that terminal end 80 is spaced some distance from face 79 of extension 78. Contact 84 is threadedly received in bushing 86, which is positioned in plug 70, and has a contact portion 88 extending into recess 82 and spaced from face 79. Preferably lock nut 90 secures terminal 92 to contact 84 and to bushing 86, as best shown in FIG. 3. In this way, terminal 92 may be connected to one pole of a power source (not shown).

Plastically deformed spring 94, which includes a disc or a flat spring, and which is similar to spring 52, is mounted on terminal end 80 of extension 78. Ferrule 96, comprised of a conductive material, is mounted about recess 82 and terminal end 80 and thereby clamps spring 94 to terminal end 80. Ferrule 96 has a central aperture 98 therethrough so that spring 94 may be engaged by mass 100. Screw contact 102 extends through housing 64 and bears against the sidewall of ferrule 96 and thereby maintains ferrule 96 mounted to extension 78. In this way, the spring disc 94 is maintained on the non-conductive terminal end 80 and is free to flip from the concave position of FIG. 4 to the convex position of FIG. 5. Naturally, contact 102 is connected to the opposite pole of a power source to which contact 92 is connected.

Plug 74 is movable in end 72 and has an end face 75 engageable with mass 100. The volume of chamber 76 may be regulated by movement of plug 74. The movement of mass 100 required to flip spring 94 may be adjusted by movement of plug 74.

As can be seen from FIG. 5, aperture 98 is sized to permit entry therethrough of only a relatively small portion of spherical mass 100. This is because the spring 94 will remain in the convex or circuit closed position once the spring 94 has been depressed by more than ½ the depth of the spring arc. It is therefore not necessary that the mass 100 be used to maintain the spring 94 in the convex or closed position.

As best shown in FIG. 6, longitudinal displacement of screw contact 84 into the housing 64 causes the spring 94 to flip to the first or circuit open position. This causes the sensor I2 to be reset and to thereby be ready once again to detect a collision. This reset provision is important when calibration of the sensor I2 is necessary or when the sensor is undergoing repeated testing.

Impact sensor I3 is best shown in FIG. 7 and includes a generally cylindrical housing 104 comprised of a resilient insulating material. Housing 104 has an integral deformable closure member 106 closing a first end of housing 104 and a second deformable integral closure member 108 closing the opposite end of housing 104. Closure member 106 has a central movable portion 110 with a terminal or forward end 112 extending a substantial distance into housing 104, for reasons to be explained hereinafter.

Ring contact 114 is mounted in housing 104 and rests upon closure member 106 and has a diameter substantially equal to the inner diameter of housing 104. Contact 116 extends outwardly from ring contact 114 through opening 118 in housing 104 and is adapted for connection to a first pole of a power source (not shown). A planar contact member 120 is intergral with contact 114 and is positioned generally intermediate the ends thereof. Planar member 120 has a central aperture 122 therethrough through which terminal end 112 of portion 110 extends. Arched contact 124 is pivotally mounted to planar portion 120 by rivet 126 and is adapted for pivoting away from planar portion 120 in response to inward movement of portion 110.

Ring contact 114 has an annular recess or groove 128 disposed about the upper end thereof and in which insulating material 130 is received. Insulating material 130 has a terminal end 132 on which the peripheral edge 134 of plastically deformed spring 136 is received. Insulating material 130 has an annular recess 138 thereabout in which ferrule 140 is received. Ferrule 140 has a shoulder 142 overlying peripheral edge 134 and terminal end 132 and thereby clamps spring 136 to insulating material 130. Contact 144 extends outwardly of ferrule 140 through opening 146 in housing 104. The contact 144 is adapted for connection to the other pole of the power source (not shown).

Mass 148 is integral with or is secured to face 150 of closure portion 108. The mass 148 is coaxial with the aperture 122 of planar portion 120 and is engagable with spring 136 for causing the spring 136 to shift or flip from the concave position of FIG. 7 to the convex position wherein the spring 136 engages pivotal contact 124 and thereby establishes electrical connection between the contacts 116 and 144. Resetting of the sensor I3 is accomplished by inward movement of portion 110 sufficient to cause the terminal end 112 to engage the contact 124 and to thereby cause the contact 124 to pivot by an amount sufficient to cause the spring 136 to shift from the convex to the concave position.

While this invention has been described as having a preferred design, it is understood that it is capable of further modifications, uses and/or adaptations of the invention following in general the principle of the invention and including such departures from the present disclosure has come within known or customary practice in the art to which the invention pertains, and as may be applied to the central features hereinbefore set forth, and fall within the scope of the invention of the limits of the appended claims.

What I claim is:

1. An impact sensor, comprising:

(a) a housing having an inner chamber;

(b) a first electrical contact has a contact portion projecting into said chamber;

(c) a second electrical contact in said housing is spaced from said first contact and has an aperture surrounding said contact portion;

(d) insulating means disposed between said contacts for maintaining electrical isolation of said contacts;

(e) a plastically deformed conductive arcuate spring means is in electrical connection with said second contact and is associated with said aperture and has a first position arched away from said contact portion and a second position arched toward and engaged with said contact portion for thereby establishing electrical connection between said contacts; and, (f) a mass movably received within said chamber is engagable with said spring means for shifting said spring means from said first to said second position when said mass is subjected to a preselected force.

2. The sensor as defined in claim 1, wherein:
(a) said spring means includes a generally hemispherical disc.

3. The sensor as defined in claim 1, wherein:
(a) each of said contacts having flat portions of substantial length; and,
(b) said flat portions being disposed in substantially parallel relation.

4. The sensor as defined in claim 3, wherein:
(a) said second contact being disposed between said mass and said first contact.

5. The sensor as defined in claim 3, wherein:
(a) an aperture in said first contact being aligned with said second contact aperture; and,
(b) a stud being disposed in said first contact aperture and having a portion thereof providing said contact portion.

6. The sensor as defined in claim 5, wherein:
(a) said apertures being coaxial; and,
(b) said second contact aperture having a diameter exceeding the diameter of said first contact aperture.

7. The sensor as defined in claim 5, wherein:
(a) said stud being selectively movable generally transverse to the plane of said first contact for shifting said spring means from said second to said first position.

8. The sensor as defined in claim 3, wherein:
(a) an aperture in said housing communicating with said chamber; and,
(b) a movable stud being received in said housing aperture and having a portion engagable with said mass for moving said mass a predetermined distance and for thereby causing said spring means to flex so that the movement of said mass required to shift from said first to said second position is reduced.

9. The sensor as defined in claim 7, wherein:
(a) an aperture in said housing communicating with said chamber and being coaxial with said first contact aperture; and,
(b) a movable stud being received in said housing aperture and having a portion engagable with said mass for moving said mass a predetermined distance and thereby causing said spring means to flex so that the movement of said mass required to shift said spring means from said first to said second position is reduced.

10. The sensor as defined in claim 3, wherein:
(a) said housing comprised of first and second sections having contiguous faces;
(b) each of said faces having a first and a second recess of substantial length;
(c) each of said contacts being positioned in an associated one of said recesses so that said contacts are maintained in position in said housing; and,
(d) means securing said sections together.

11. The sensor as defined in claim 1, wherein:
(a) said second contact being disposed generally transverse to said first contact.

12. The sensor as defined in claim 11, wherein:
(a) said housing being cylindrical;
(b) a first plug closing one end of said housing and a second plug closing the other end of said housing and said second plug being spaced from said first plug for thereby providing said chamber;
(c) said first plug including an extension having a terminal end disposed in said chamber;
(d) said spring means being mounted to said terminal; and,
(e) a ferrule being mounted to said terminal end for clamping said spring means therebetween.

13. The sensor as defined in claim 12, wherein:
(a) conductive screw means extending through said housing and engaging a side portion of said ferrule for maintaining said ferrule seated on said terminal end.

14. The sensor as defined in claim 12, wherein:
(a) said first contact including a stud movably positioned in said first plug and being adapted for shifting said spring means from said second to said first position.

15. The sensor as defined in claim 12, wherein:
(a) said second plug being movably positioned in said housing and being adapted for moving said mass a predetermined distance and for thereby causing said spring means to flex so that the movement of said mass required to shift said spring means from said first to said second position is reduced.

16. The sensor as defined in claim 1, wherein:
(a) said housing being generally cylindrical in shape and having a first deformable member closing a first end of said housing and a second deformable member closing the other end of said housing;
(b) said mass being, secured to said second deformable member;
(c) a ring electrode being positioned in said housing proximate said first end and having means for connection to a first pole of a power source;
(d) said ring electrode including a planar portion intermediate said first deformable member and said spring means and said planar portion having an aperture therethrough; and,
(e) a movable contact being pivotally connected to said planar portion and overlying said planar portion aperture and being engageable with said spring means when said spring means is in said second position for thereby establishing electrical connection between said contacts and said first deformable member adapted for selectively engaging said movable contact through said aperture and for thereby causing said movable contact to pivot and to thereby shift said spring means from said second to said first position.

17. The sensor as defined in claim 16, wherein:
(a) an annular recess being proximate one end of said ring electrode; and,
(b) said second contact having a portion thereof positioned within said recess for clamping said spring means therebetween.

18. The sensor as defined in claim 1, wherein:
(a) means being associated with said housing and overlying the peripheral edge of said spring means for clamping said spring means to said second contact.

19. An impact sensor mountable to a mobile vehicle for detecting a collision, comprising:
(a) a housing comprised of an insulating material and said housing having a chamber therein;
(b) first and second spaced contacts, each of said contacts including means permitting connection to a power source and each of said contacts having a portion thereof within said chamber;

(c) said second contact portion having an aperture therethrough aligned with and spaced from said first contact portion;

(d) a plastically deformed conductive arched spring means is in electrical connection with said second contact portion generally along the periphery of said aperture and has a first concave position and a second convex position wherein a portion of said spring means engages and establishes electrical connection with said first contact portion for thereby permitting current to flow between said contacts when said connecting means are connected to a power source; and, (e) a mass movably received in said chamber is engagable with said spring means for shifting said spring means from said first to said second position upon application of a predetermined force to said mass.

20. The sensor as defined in claim 19, wherein:

(a) each of said contacts having flat portions so that said contacts are disposed in spaced parallel relation and said second contact being disposed between said first contact and said mass;

(b) reset means being associated with said first contact portion for shifting said spring means from said second to said first position; and, (c) biasing means being associated with said housing and being operably engaged with said mass for urging said mass against said spring means and for thereby causing said spring means to be partially depressed so that the movement of said mass required to shift said spring means from said first to said second position is decreased.

21. The sensor as defined in claim 19, wherein:

(a) said housing being generally cylindrical and having a first plug with a terminal end extending into said housing closing a first end of said housing and a second plug longitudinally spaced from said terminal end closing a second end of said housing and providing said chamber;

(b) said first contact being coaxially mounted to said first plug and having a contact portion extending into said chamber;

(c) said spring means being mounted to said terminal end proximate said contact portion for engaging said contact portion when in said second position and said spring means being coaxial with said contact portion;

(d) a ferrule being mounted about said terminal end clamping said spring means thereto and maintaining said spring means in position on said terminal end; and, (e) said second contact including a portion thereof engaged with a side portion of said ferrule for securing said ferrule to said terminal end and said portion extending generally transverse to the axis of said cylinder.

22. The sensor as defined in claim 19, wherein:

(a) said housing being comprised of a resilient material and being generally cylindrically-shaped and having a first deformable member closing a first end of said housing and a second deformable member closing a second end of said housing;

(b) said connecting means extend outwardly or said housing generally transverse to the axis of said cylinder;

(c) said first contact including a first ring contact seated on said first deformable member and having a planar portion spaced therefrom generally transverse to the axis of said cylinder and an annular recess proximate one end thereof;

(d) an aperture in said planar portion being coaxial with the axis of said cylinder;

(e) a contact member being pivotally mounted to said planar portion and overlying said aperture;

(f) insulating material being mounted in said recess;

(g) said spring means being mounted to said insulating material;

(h) a second ring contact overlying said insulating material and said spring means for clamping said spring means therebetween; and, (i) said mass being secured to said second deformable member.

* * * * *